US006807739B2

(12) United States Patent
Follo

(10) Patent No.: US 6,807,739 B2
(45) Date of Patent: Oct. 26, 2004

(54) SHAVING DEVICE

(75) Inventor: Thomas A. Follo, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/277,591

(22) Filed: Oct. 21, 2002

(65) Prior Publication Data

US 2003/0074798 A1 Apr. 24, 2003

Related U.S. Application Data

(60) Provisional application No. 60/343,404, filed on Oct. 22, 2001.

(51) Int. Cl.[7] ..... B26B 21/00

(52) U.S. Cl. ..... 30/527; 30/41; 30/50; 30/342

(58) Field of Search ..... 30/527, 34.05, 30/40.2, 51, 57, 538, 541, 529, 34.2, 41, 50

(56) References Cited

U.S. PATENT DOCUMENTS

| | | | | | |
|---|---|---|---|---|---|
| 3,935,639 | A | | 2/1976 | Terry et al. | 30/47 |
| 3,938,247 | A | * | 2/1976 | Carbonell et al. | 30/47 |
| 3,950,849 | A | * | 4/1976 | Perry | 30/47 |
| 4,063,354 | A | * | 12/1977 | Oldroyd et al. | 30/47 |
| 4,170,821 | A | | 10/1979 | Booth | 30/41 |
| 4,483,068 | A | * | 11/1984 | Clifford | 30/49 |
| 4,514,904 | A | * | 5/1985 | Bond | 30/530 |
| 4,562,644 | A | * | 1/1986 | Hitchens | 30/41 |
| 4,756,082 | A | * | 7/1988 | Apprille, Jr. | 30/530 |
| 4,985,995 | A | | 1/1991 | Coffin | |
| 5,056,222 | A | | 10/1991 | Miller et al. | 30/77 |
| 5,168,628 | A | * | 12/1992 | Mock et al. | 30/41 |
| 5,251,376 | A | * | 10/1993 | Althaus et al. | 30/50 |
| 5,564,190 | A | * | 10/1996 | Fleetwood | 30/41 |
| 5,661,907 | A | | 9/1997 | Apprille, Jr. | 30/47 |
| 5,781,997 | A | * | 7/1998 | Ferraro et al. | 30/50 |
| 5,933,960 | A | * | 8/1999 | Avidor | 30/34.2 |
| 5,953,824 | A | | 9/1999 | Ferraro et al. | 30/527 |
| 5,966,822 | A | | 10/1999 | Coffin et al. | 30/541 |
| 6,112,412 | A | | 9/2000 | Richard | 30/41.5 |
| 6,122,826 | A | | 9/2000 | Coffin et al. | 30/57 |
| 6,138,361 | A | | 10/2000 | Richard et al. | 30/50 |
| 6,161,287 | A | | 12/2000 | Swanson et al. | 30/50 |

FOREIGN PATENT DOCUMENTS

| | | | |
|---|---|---|---|
| WO | WO9955499 | 11/1999 | B26B/21/40 |

* cited by examiner

*Primary Examiner*—Allan N. Shoap
*Assistant Examiner*—Phong Nguyen
(74) *Attorney, Agent, or Firm*—McCormick, Paulding & Huber LLP

(57) ABSTRACT

According to the present invention, a razor assembly is provided that includes a handle, a pivot member, and a cartridge. The pivot member is attached to the handle, and includes an exterior contact surface that extends along the length of the cartridge. The cartridge and the pivot member are preferably pivotal relative to one another. The cartridge includes a frame, and one or more razor blades. Each of the one or more razor blades includes a cutting edge, and the cutting edges are positioned contiguous with a shave plane. The pivot member is positioned forward of the one or more razor blades, and positioned such that at least a portion of the exterior contact surface of the pivot member is disposed contiguous with the shave plane.

15 Claims, 3 Drawing Sheets

SHAVING DEVICE

CROSS-REFERENCE TO RELATED APPLICATION

This application claims priority from U.S. provisional application No. 60/343,404 filed on Oct. 22, 2001.

BACKGROUND OF THE INVENTION

1. Technical Field

This invention relates to shaving devices in general, and to shaving devices having a pivotally attached cartridge in particular.

2. Background Information.

Modern safety razors include a plurality of blades disposed within a cartridge that is mounted on a handle. Some safety razors have a disposable cartridge for use with a reusable handle, while others have a handle and cartridge that are combined into a unitary disposable. Although a variety of razor cartridge configurations exist, most include a frame made of a rigid plastic and a plurality of razor blades mounted in the frame. The frame includes a seat portion and a cap portion, and the blades are disposed between the cap and the seat. The cartridge further includes a guard disposed forward of the blades and a cap is disposed aft of the blades. The guard and the cap orient the position of the person's skin relative to the blades to optimize the shaving action of the blade. The terms "forward" and "aft", as used herein, define relative position between features of the razor. A feature "forward" of the razor blades, for example, is positioned so that the surface to be shaved encounters the feature before it encounters the razor blades, if the razor assembly is being stroked in its intended cutting direction (e.g., the guard is forward of the razor blades). A feature "aft" of the razor blades is positioned so that the surface to be shaved encounters the feature after it encounters the razor blades, if the razor assembly is being stroked in its intended cutting direction (e.g., the cap is disposed aft of the razor blades).

The comfort and performance provided by a particular razor are critical to the commercial success of the razor. Improvements that benefit razor comfort, performance, and ease of use, however significant or subtle, can have a decided impact on the commercial success of a razor. A razor guard that can draw the user's skin taut is an example of a feature that directly affects the comfort and performance of the razor. The attachment mechanism between a replaceable cartridge and the handle of the razor is an example of a feature that can significantly affect the razor's ease of use. Presently available razor cartridge attachment mechanisms typically employ a plurality of small features (e.g., tabs, posts, etc.) to attach the cartridge to the handle. In many instances, the small attachment features increase the difficulty of attaching the handle and cartridge to one another. This is particularly true when it is not apparent how the small features attach the cartridge to the handle. The small features also often make the razor components difficult to manufacture, susceptible to mechanical problems (e.g., misalignment, failure, etc.), and expensive to manufacture. Because most presently available razor attachment mechanisms are complex, they are typically disposed in the reusable handle. If the cartridge attachment mechanism fails in the handle, the user is left stranded. Additional cartridges will not solve the problem. The user must change razors, assuming an alternative razor is available.

What is needed, therefore, is a razor assembly that facilitates the function of the guard, one that has a cartridge pivotally attached to a handle, one that can utilize a replaceable cartridge that can be easily loaded and unloaded, and one that provides desirable comfort and performance.

DISCLOSURE OF THE INVENTION

It is, therefore, an object of the present invention to provide a razor that provides improved performance relative to existing razors, and one that is more comfortable to use than existing razors.

According to the present invention, a razor assembly is provided that includes a cartridge, a handle, and a pivot member. The cartridge includes a frame, one or more razor blades, and a guard. As will be described herein in detail, some embodiments of the present invention utilize a cartridge that is not intended to be separated from the handle for replacement purposes, and in other embodiments the cartridge is replaceable and the handle reusable. The guard and the one or more razor blades are attached to the frame. Each of the one or more razor blades includes a cutting edge, and the cutting edges of the one or more razor blades are positioned contiguous with a shave plane. The pivot member has an exterior contact surface that extends along the length of the pivot member. The pivot member is positioned between the guard and the one or more razor blades of the cartridge. At least a portion of the exterior surface of the pivot member is disposed adjacent the shave plane. The pivot member is preferably rigid and fixedly attached to the handle, and the cartridge is preferably pivotally mounted relative to the pivot member. In some embodiments, the cartridge is selectively detachable from the pivot member, and in other embodiments the pivot member and cartridge are selectively detachable from the handle.

According to an embodiment of the present invention, the pivot member functions as a manifold for dispensing one or more shaving aids along the portion of the pivot member disposed adjacent the shave plane.

Several advantages are provided by the cartridge, the handle, and the pivot member of the present invention. For example, the size and the position of the pivot member within the cartridge enable the guard and the one or more razor blades to pivot about the pivot member, on opposite sides of the pivot member. As a result, force applied to the blades during use causes the guard to rotate toward, and apply force against, the user's skin thereby increasing the ability of the guard to engage the user's skin. The position of the pivot member surface between the guard and the one or more razor blades also facilitates the engagement of the user's skin by providing a surface over which the user's skin can be drawn taut.

Another advantage provided by the present invention razor assembly is easy loading and unloading of the razor cartridge. The substantially rigid pivot member enables the user to easily determine how the cartridge is loaded and unloaded from the handle. A person who has used existing replaceable razor cartridges will recognize that it is very often less than clear how the cartridge and handle attach to one another, particularly when attachment is accomplished via a plurality of small features. The substantially rigid pivot member attached to the handle and the one or more clip members attached to the replaceable cartridge, in contrast, make it quite clear how the cartridge is attached to the handle.

In the embodiment where the cartridge is replaceable, the size (e.g., diameter and length) and rigidity of the pivot member help to provide a connection between the handle and the replaceable cartridge that favorably supports the replaceable cartridge along its length, thereby eliminating the undesirable deflection that can be a characteristic of the small attachment features used in many presently available products.

Another advantage of the present invention is ability of the pivot member to function as a manifold for dispensing a shaving aid. Dispensing a shaving aid between the guard and the one or more razor blades ensures that the shaving aid will not be removed by the guard. Dispensing a shaving aid over the skin drawn taut by the guard forward of the one or more razor blades also facilitates a uniform application of the shaving aid.

These and other objects, features, and advantages of the present invention will become apparent in light of the detailed description of the present invention.

DETAILED DESCRIPTION OF THE INVENTION

Figure 1:
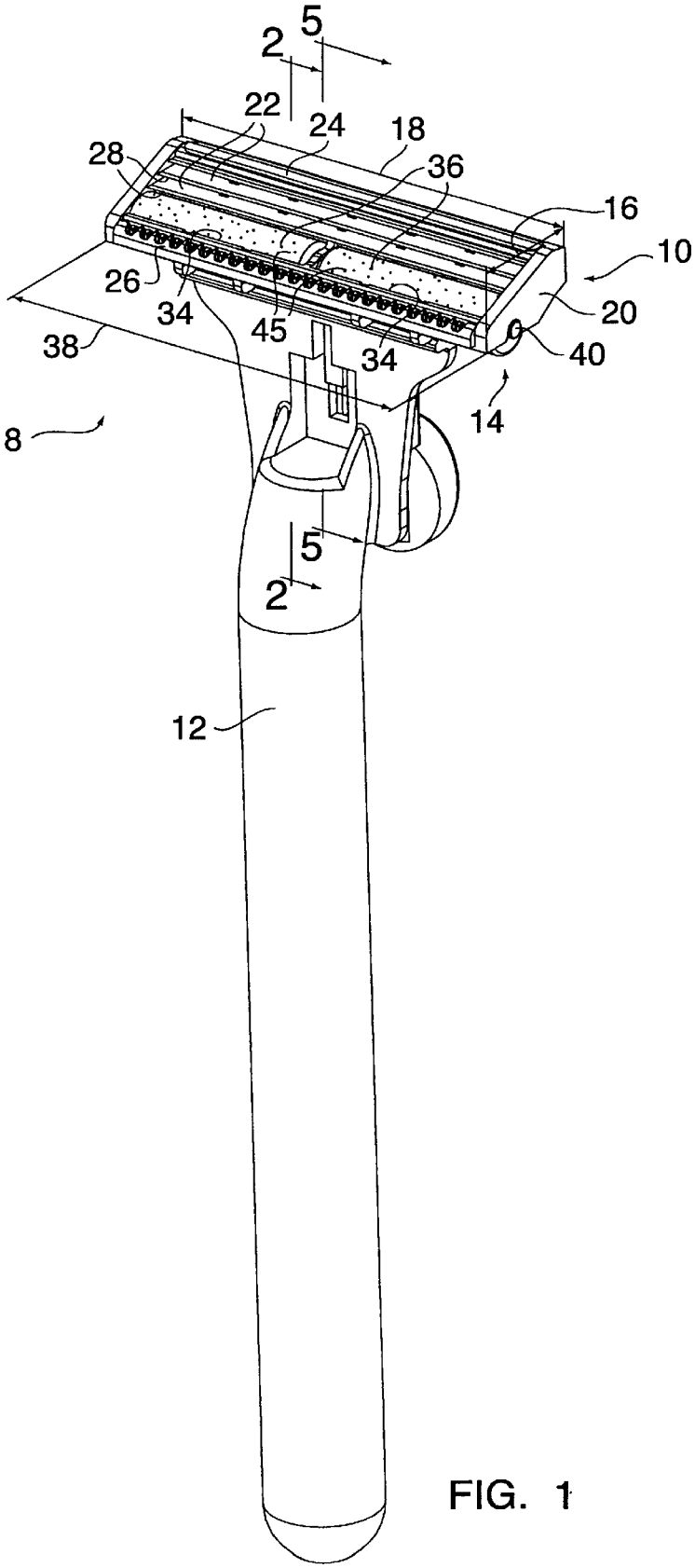
FIG. 1 is a perspective view of a razor assembly.

Referring to FIG. 1, a razor assembly 8 includes a cartridge 10, a handle 12, and a pivot member 14. The cartridge 10 has a width 16 and a length 18 and includes a frame 20, one or more razor blades 22, a cap 24, and a guard 26. The guard 26, cap 24, and one or more razor blades 22, are attached to the frame 20. Each of the one or more razor blades 22 includes a cutting edge 28, and the cutting edges 28 each extend lengthwise and are contiguous with a shave plane 30. The shave plane 30 (see FIG. 3) represents the theoretical position of the surface being shaved, and is defined by a widthwise extending line 32 that is tangential to the outer surfaces of the cap 24 and guard 26, and a lengthwise extending line (not shown) that extends along the length 18 of the cartridge 10. The frame 20 includes one or more open ports 34 disposed between the guard 26 and the one or more razor blades 22. The guard 26 is attached to the frame 20 forward of the ports 34. The cap 24 is disposed aft of the cutting edges 28 of the razor blades 22. A variety of guards 26 can be used with the present invention. Guards 26 are well known in the art and will therefore not be discussed further here other than to say the present invention is not limited to being used with any particular type of guard 26.

Figure 2:
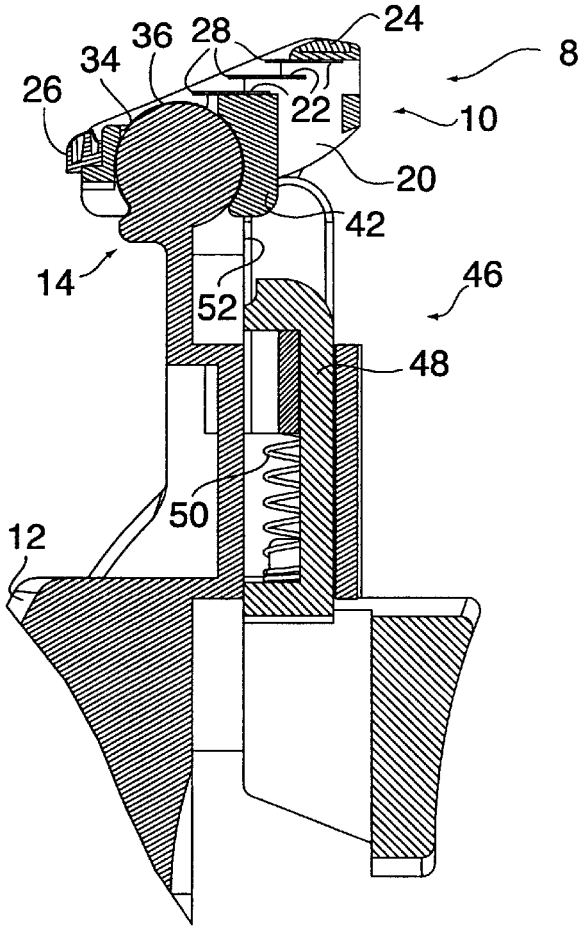
FIG. 2 is a diagrammatic sectional view of a present invention cartridge mounted on a pivot member taken along line 2—2 of FIG. 1.
Figure 3:
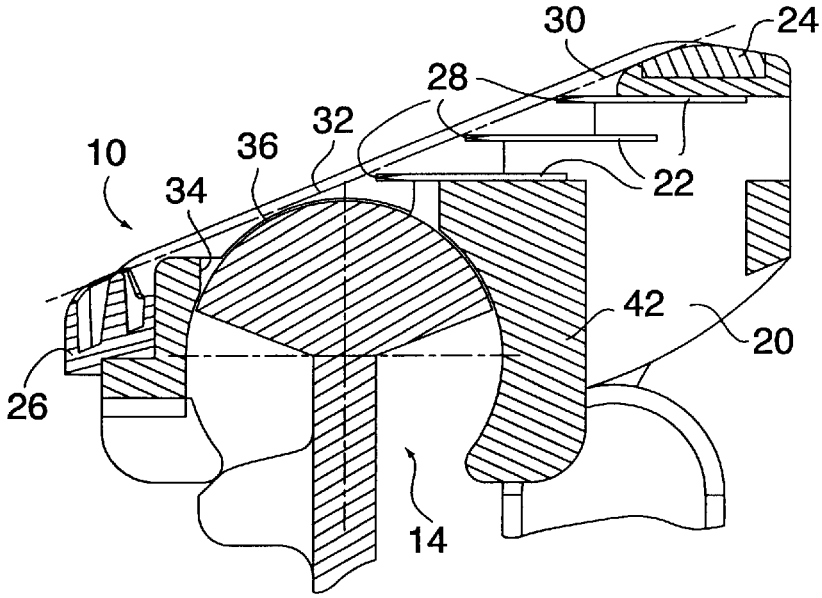
FIG. 3 is a diagrammatic sectional view of a present invention cartridge mounted on an alternative embodiment of a pivot member.
Figure 4:
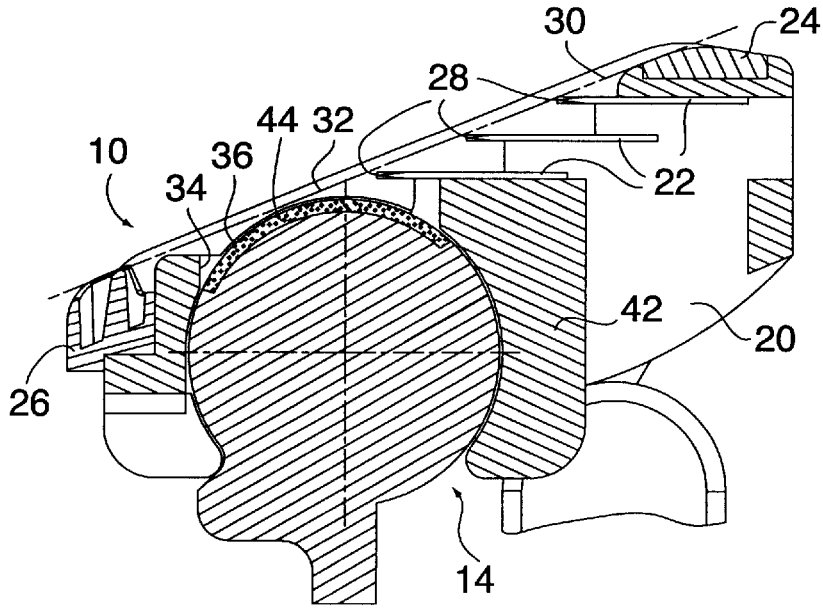
FIG. 4 is a diagrammatic sectional view of a present invention cartridge mounted on an alternative embodiment of a pivot member.

Referring to FIGS. 1–4, the pivot member 14 has an exterior contact surface 36 that extends along the length 38 of the pivot member 14. The pivot member 14 is positioned between the guard 26 and the one or more razor blades 22 of the cartridge 10. At least a portion of the exterior contact surface 36 of the pivot member 14 extends through the one or more ports 34 and is disposed adjacent the shave plane 30. The portion of the exterior contact surface 36 of the pivot member 14 disposed adjacent the shave plane 30 is preferably substantially arcuate in widthwise cross-section. The pivot member 14 shown in FIG. 2, for example, is substantially cylindrical in widthwise cross-section. FIG. 3 shows another embodiment where the pivot member 14 has a wedge-shaped widthwise cross-section. The pivot member 14 is not limited, however, to either of these widthwise cross-sectional embodiments. The widthwise cross-section of the pivot member 14 is also not limited to an arcuate cross-sectional shape. The length 38 of the pivot member 14 is preferably equal to or greater than one-half of the length 18 of the cartridge 12. In a more preferred embodiment, the length 38 of the pivot member 14 is equal to or greater than three-quarters of the length 18 of the cartridge 10.

The pivot member 14 is preferably fixedly attached to the handle 12. The cartridge 10 is preferably pivotally mounted relative to the pivot member 14. In one embodiment, the pivot member 14, handle 12, and cartridge 10 are assembled in a manner wherein disassembly (i.e., "unloading") of the cartridge 10 from the handle 12 during regular use is not intended (i.e., a unitary disposable razor assembly). In another embodiment, the cartridge 10 is replaceable and is therefore selectively detachable from the pivot member 14 and handle 12. In still another embodiment, the cartridge 10 and the pivot member 14 are combined into a unitary replaceable cartridge selectively detachable from the handle 12 for replacement purposes. The latter embodiment has particular utility when the pivot member 14 functions as a shaving aid dispenser (see FIG. 4) as will be described below.

Now referring to FIGS. 1–5, the pivotal attachment between the pivot member 14 and the cartridge 10 can be accomplished in a variety of ways. In one embodiment (see FIG. 1), stub axles 40 that extend out from the lengthwise ends of the pivot member 14 are received within the frame 20 of the cartridge 10. In another embodiment (see FIG. 4), clips 42 attached to the frame 20 of the cartridge 10 act on the pivot member 14, and thereby pivotally attach the cartridge 10 to the pivot member 14. In some embodiments, both stub axles 40 and clips 42 are used. Other attachment schemes can be used alternatively.

The pivot member 14 may contain a shaving aid and include a mechanism 44 for dispensing the shaving aid. Shaving aids (e.g., lubricating agents, drag reducing agents, depilatory agents, cleaning agents, medicinal agents, etc.) are well known and therefore will not be further described herein. The mechanism 44 for dispensing the shaving aid can vary to suit the application and the shaving aid. For example, the portion of the exterior contact surface 36 disposed adjacent the shave plane 30 may include a shaving aid in the form of a water-soluble material that is applied to the skin forward of the razor blades 22. The water-soluble material (e.g., a lubricant) facilitates the razor action without inhibiting the ability of the guard to draw the skin taut. Alternatively, the pivot member 14 can include perforations 45 within the exterior contact surface 36 or have a permeable exterior contact surface 36 to allow shaving aid disposed within the pivot member 14 to dispense therethrough. Other mechanisms for dispensing shaving aid from the pivot member 14 may be used alternatively.

Figure 5:
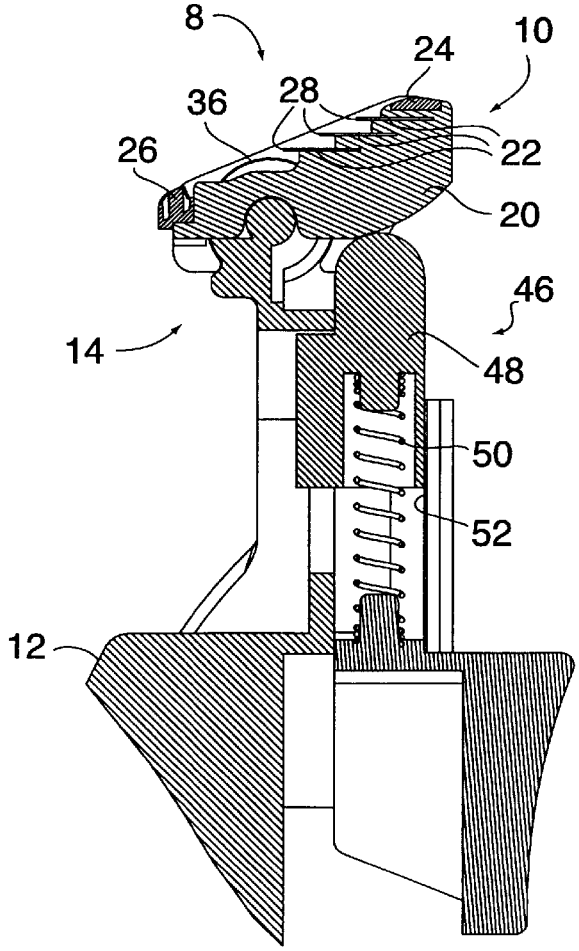
FIG. 5 is a diagrammatic sectional view of a present invention razor assembly showing a cartridge biasing mechanism taken along line 5—5 of FIG. 1.

Now referring to FIGS. 2 and 5, in a preferred embodiment, the razor assembly 8 further includes a cartridge biasing mechanism 46 aft of the pivot member 14. The cartridge biasing mechanism 46 biases the cartridge 10 into a normal position and resists rotation of the cartridge 10 in one direction as will be described below. The mechanism 46 includes a plunger 48 and a spring 50 acting on one end of the plunger 48. The plunger 48 shown in FIG. 2 is received within and guided by a channel 52. Other guiding means may be used alternatively. The spring 50 shown in FIGS. 2 and 5 is a coil spring. Other cartridge biasing mechanisms 46 may be used alternatively.

In the operation of the razor assembly, the razor cartridge 10 is drawn along in a direction parallel to the shave plane 30 with some amount of force directed normal to the shave plane 30. The friction between the hair and the razor blades 22, and the cutting force of the blades 22 acting on the hair, (collectively referred to as the shaving force) act along an imaginary line parallel to the shave plane 30. The distance between the imaginary line along which the shaving force acts and the centerline of the pivot member 14 creates a moment arm for the shaving force. The shaving force acting on the cartridge 10 of the razor assembly 8 urges the cartridge 10 to rotate about the pivot member 14; i.e., rotation of the razor blades 22 in a direction away from the shave plane 30 and rotation of the guard 26 in a direction toward the shave plane 30. As a result of that force/moment coupling and consequent rotational movement, the normal force of the guard 26 acting on the skin is increased thereby improving the ability of the guard 26 to frictionally pull the skin taut for shaving. In the preferred embodiment wherein the razor assembly 8 further includes a cartridge biasing mechanism 46, the cartridge biasing mechanism 46 acts on the cartridge 10 to resist the above-described rotation of the cartridge 10. Specifically, rotation of the cartridge 10 causes the plunger 48 to travel within the channel 52 and compress the spring 50 disposed therein. Once the normal force is removed from the cartridge 10, the compressed spring 50 releases and forces the cartridge 10 to rotate about the pivot member 14 in the opposite direction eventually resting in the normal position.

Although this invention has been shown and described with respect to the detailed embodiments thereof, it will be understood by those skilled in the art that various changes in form and detail thereof may be made without departing from the spirit and scope of the invention.

What is claimed is:

1. A razor assembly, comprising:

a handle;

a pivot member attached to the handle, the pivot member further comprising a mechanism for dispensing shaving aid, said mechanism including an exterior contact surface that extends along a length; and a cartridge that is pivotally attached to the pivot member, wherein the cartridge includes a length, a frame, and one or more razor blades, wherein each of the one or more razor blades includes a cutting edge, and the cutting edges of the one or more razor blades are substantially contiguous with a shave plane;

wherein the pivot member is positioned forward of the one or more razor blades, and at least a portion of the exterior contact surface is disposed contiguous with the shave plane.

2. The razor assembly of claim 1, wherein the pivot member is fixedly attached to the handle.

3. The razor assembly of claim 1, further comprising a guard attached to the cartridge, forward of the pivot member.

4. The razor assembly of claim 1, wherein the pivot member has a length and a substantially cylindrical widthwise cross-section, and the length of the pivot member extends substantially parallel to the length of the cartridge.

5. The razor assembly of claim 4, wherein the pivot member extends lengthwise across more than half of the length of the cartridge.

6. The razor assembly of claim 4, wherein the pivot member extends lengthwise across three-quarters or more of the length of the cartridge.

7. The razor assembly of claim 1, wherein the cartridge includes one or more clips and the cartridge is pivotally attached to the pivot member by the one or more clips.

8. The razor assembly of claim 1, wherein the handle is selectively detachable from the pivot member.

9. The razor assembly of claim 1, wherein the mechanism for dispensing shaving aid includes a plurality of apertures defined by the exterior contact surface, such that the plurality of apertures permit dispensing of a shaving aid to the exterior contact surface.

10. The razor assembly of claim 1, wherein the mechanism for dispensing shaving aid includes a permeable member disposed within the exterior contact surface, such that the permeable member permits dispensing of a shaving aid to the exterior contact surface.

11. The razor assembly of claim 1, wherein the mechanism for dispensing shaving aid includes a water-soluble lubricious material attached to the exterior contact surface.

12. The razor assembly of claim 1 wherein the portion of the exterior contact surface disposed contiguous with the shave plane is arcuate in widthwise cross-section.

13. The razor assembly of claim 12, wherein the exterior contact surface has a substantially cylindrically shaped widthwise cross-section.

14. The razor assembly of claim 1, wherein the pivot member further comprises a pair of lengthwise ends and a stub axle extending out from each lengthwise end.

15. The razor assembly of claim 1, further comprising a cartridge biasing mechanism.

* * * * *